US009597560B2

(12) United States Patent
Narita et al.

(10) Patent No.: US 9,597,560 B2
(45) Date of Patent: Mar. 21, 2017

(54) GOLF CLUB HEAD

(71) Applicant: Bridgestone Sports Co., Ltd., Tokyo (JP)

(72) Inventors: Tadahiro Narita, Chichibu (JP); Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 14/876,969

(22) Filed: Oct. 7, 2015

(65) Prior Publication Data

US 2016/0166892 A1 Jun. 16, 2016

(30) Foreign Application Priority Data

Dec. 10, 2014 (JP) ..... 2014-250299

(51) Int. Cl.
*A63B 53/04* (2015.01)
*A63B 53/02* (2015.01)

(52) U.S. Cl.
CPC ..... *A63B 53/0466* (2013.01); *A63B 53/02* (2013.01); *A63B 53/04* (2013.01); *A63B 2053/0437* (2013.01); *A63B 2225/01* (2013.01)

(58) Field of Classification Search
CPC .. A63B 53/0466; A63B 53/04; A63B 53/0437
See application file for complete search history.

(56) References Cited

U.S. PATENT DOCUMENTS 4,747,599 A * 5/1988 Antonious ..... A63B 53/0487 473/313
4,948,140 A * 8/1990 Antonious ..... A63B 53/02 473/313
5,120,061 A * 6/1992 Tsuchida ..... A63B 53/04 473/305
5,575,725 A 11/1996 Olsavsky
5,674,136 A 10/1997 Gorse
5,827,132 A 10/1998 Bamber
7,169,063 B2 * 1/2007 Tuttle ..... A63B 53/02 473/345
7,713,138 B2 5/2010 Sato et al.
8,177,659 B1 * 5/2012 Ehlers ..... A63B 53/02 473/305
8,568,247 B1 10/2013 Ehlers
8,758,157 B1 6/2014 Ehlers
(Continued)

FOREIGN PATENT DOCUMENTS

JP 02-277474 A 11/1990
JP 2000-005351 A 1/2000
(Continued)

*Primary Examiner* — John E Simms, Jr.
(74) *Attorney, Agent, or Firm* — Sughrue Mion, PLLC

(57) ABSTRACT

A golf club head of the present invention includes a hosel portion in which a shaft is inserted, the hosel portion being provided on a heel side of the golf club head, and an extended portion that extends from the hosel portion to a back side of the golf club head. The extended portion includes a distal end portion on a face portion side and a rear end portion on the back side. Out of a heel-side portion and a toe-side portion of the hosel portion, the distal end portion is connected to the heel-side portion. The rear end portion is located on the toe side with respect to the distal end portion.

5 Claims, 5 Drawing Sheets

(56) References Cited

U.S. PATENT DOCUMENTS

| | | | | |
|---|---|---|---|---|
| 2005/0032584 | A1 | 2/2005 | Van Nimwegen | |
| 2016/0067562 | A1 * | 3/2016 | Beach | A63B 53/0466 473/342 |

FOREIGN PATENT DOCUMENTS

| | | | | |
|---|---|---|---|---|
| JP | 2005005351 | A | * | 1/2000 |
| JP | 2005-237535 | A | | 9/2005 |
| JP | 2005237535 | A | * | 9/2005 |
| JP | 2009-279373 | A | | 12/2009 |

* cited by examiner

GOLF CLUB HEAD

BACKGROUND OF THE INVENTION

Field of the Invention

The present invention relates to a golf club head.

Description of the Related Art

A golf club head includes a hosel portion in which a shaft is inserted. The arrangement of the hosel portion may affect the performance of the golf club head. For example, in some cases, the weight of the hosel portion affects the center of gravity of the golf club head. Japanese Patent Laid-Open No. 2000-5351 discloses a golf club head that reduces the weight of the hosel portion and also provides a reinforcing plate to prevent its strength from lowering.

In addition, for example, the shape of the hosel portion may affect the air resistance of the golf club head. In a club such as a driver with a relatively high head speed, the air resistance of the hosel portion may affect the head speed. Each of Japanese Patent Laid-Open Nos. 2009-279373, 2005-237535, and 2-277474, Japanese Utility Model Laid-Open No. 60-128663, U.S. Pat. Nos. 8,758,157, 8,568,247, 5,674,136, and 5,575,725, and U.S. Patent Application Publication No. 2005/032584 discloses a golf club head that reduces the air resistance by the shape of the hosel portion. To the contrary, U.S. Pat. No. 5,827,132 discloses a golf club head that increases the air resistance by the shape of the hosel portion and prompts face rotation.

When reducing the air resistance, it is effective to reduce the air resistance by the shape of the hosel portion, as in Japanese Patent Laid-Open Nos. 2009-279373, 2005-237535, and 2-277474, Japanese Utility Model Laid-Open No. 60-128663, U.S. Pat. Nos. 8,758,157, 8,568,247, 5,674,136, and 5,575,725, and U.S. Patent Application Publication No. 2005/032584. However, the hosel portion may become bloated, and the weight of the golf club head may increase on the heel side. This readily moves the center of gravity of the golf club head to the heel side, resulting in disadvantage in designing the center of gravity.

SUMMARY OF THE INVENTION

According to an aspect of the present invention, there is provided a golf club head comprising: a hosel portion in which a shaft is inserted, the hosel portion being provided on a heel side of the golf club head; and an extended portion that extends from the hosel portion to a back side of the golf club head, wherein the extended portion includes a distal end portion on a face portion side and a rear end portion on the back side, out of a heel-side portion and a toe-side portion of the hosel portion, the distal end portion is connected to the heel-side portion, and the rear end portion is located on a toe side with respect to the distal end portion.

Further features of the present invention will become apparent from the following description of exemplary embodiments (with reference to the attached drawings).

DESCRIPTION OF THE EMBODIMENTS

Figure 1:
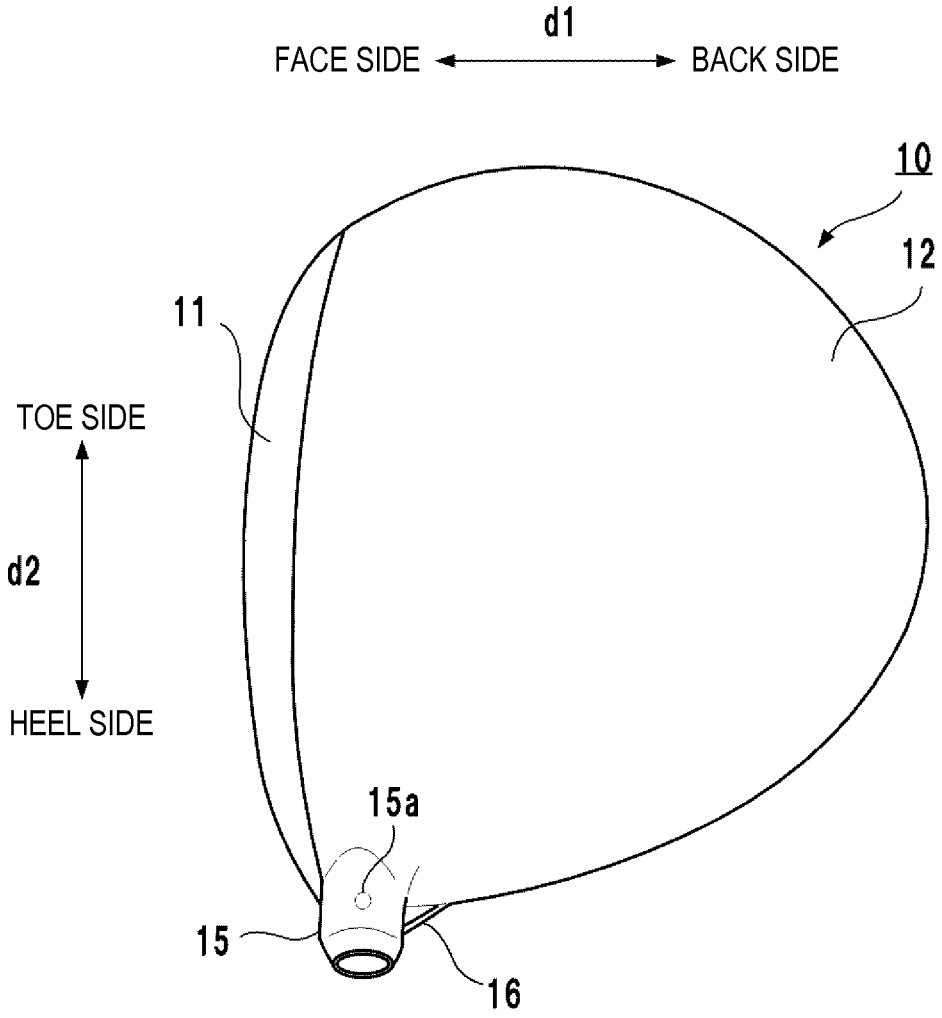
FIG. 1 is a view of a golf club head according to an embodiment of the present invention viewed from the upper side.
Figure 2:
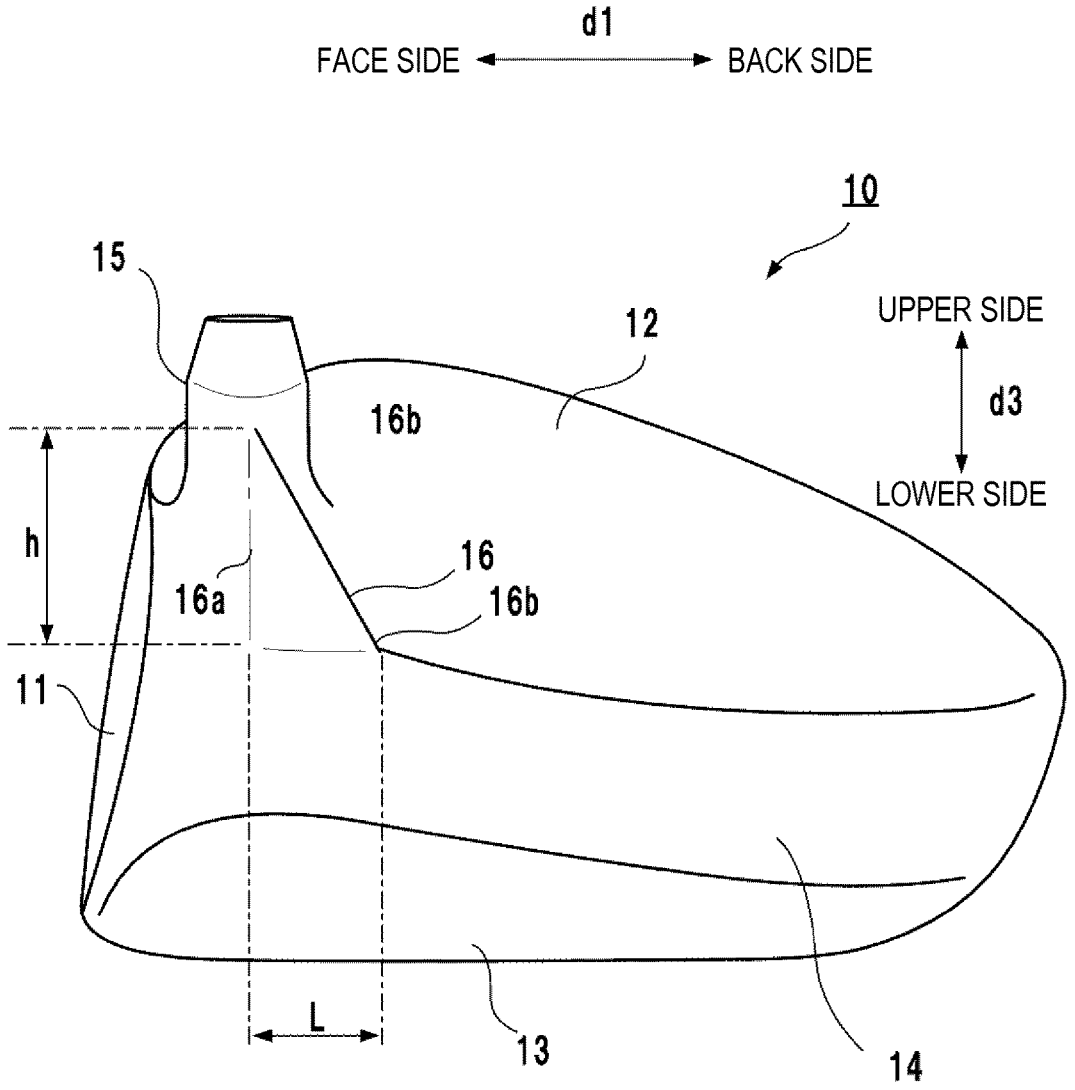
FIG. 2 is a view of the golf club head in FIG. 1 viewed from a side.

FIG. 1 is a view of a golf club head 10 according to an embodiment of the present invention viewed from the upper side. FIG. 2 is a view of the golf club head 10 viewed from a side, that is, a view of the golf club head 10 viewed from a heel side. FIGS. 1 and 2 are views respectively showing the golf club head 10 viewed from the upper side and that viewed from a side in a case where the golf club head 10 is grounded according to a predetermined lie angle and a predetermined loft angle.

The golf club head 10 forms a hollow member. The peripheral walls of the golf club head 10 constitute a face portion 11 that forms a face (striking face), a crown portion 12 that forms the upper portion of the golf club head 10, a sole portion 13 that forms the bottom portion of the golf club head 10, and a side portion 14 that forms the portion between the crown portion 12 and the sole portion 13. The golf club head 10 also includes a hosel portion 15 in which a shaft is inserted and fixed, and an extended portion 16.

In FIGS. 1 and 2, an arrow d1 indicates the face-back direction, an arrow d2 indicates the toe-heel direction, and an arrow d3 indicates the vertical direction. Normally, the face-back direction is to a target line direction (target direction of a shot). The toe-heel direction can be defined as, for example, the direction to connect the toe-side end and the heel-side end of the sole portion 13 or the direction perpendicular to the face-back direction.

The golf club head 10 is a golf club head for a driver. However, the present invention is applicable to various kinds of golf club heads including a hosel portion such as wood type golf club heads including a fairway wood other than drivers, utility (hybrid) golf club heads, other hollow golf club heads, and iron type heads.

The golf club head 10 can be made of a metal material. Examples of the metal material are a titanium-based metal (for example, titanium alloy 6Al-4V-Ti), stainless steel, and a copper alloy such as beryllium copper.

The golf club head 10 can be assembled by joining a plurality of parts. For example, the golf club head 10 can be formed from a body member and a face member. The body member forms the peripheral portions including the crown portion 12, the sole portion 13, the side portion 14, the hosel portion 15, the extended portion 16, and the face portion 11. An opening is formed at part of the portion corresponding to the face portion 11. The face member is joined to the opening of the body member.

Figure 3A:
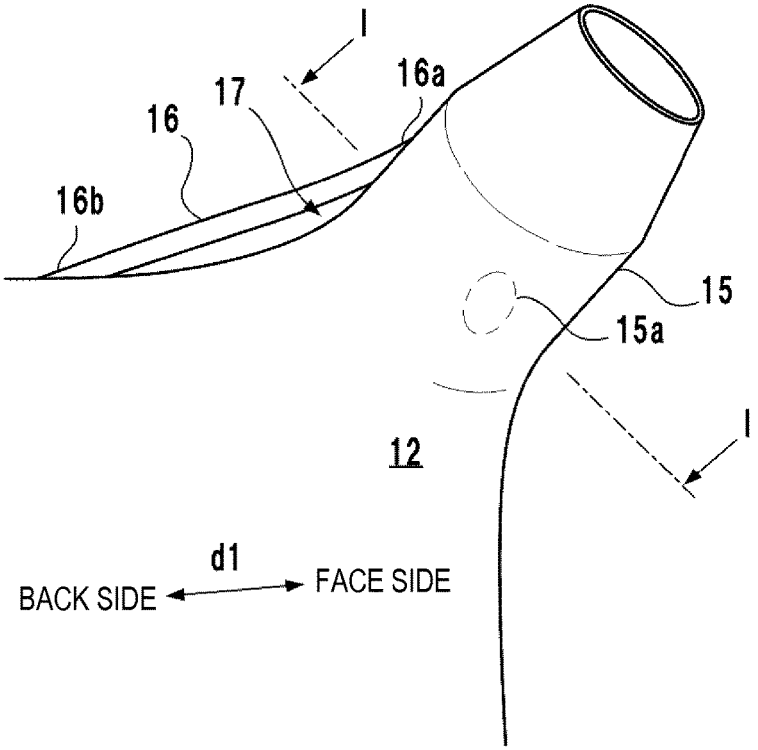
FIG. 3A is a perspective view showing the periphery of the hosel portion of the golf club head in FIG. 1.
Figure 3B:
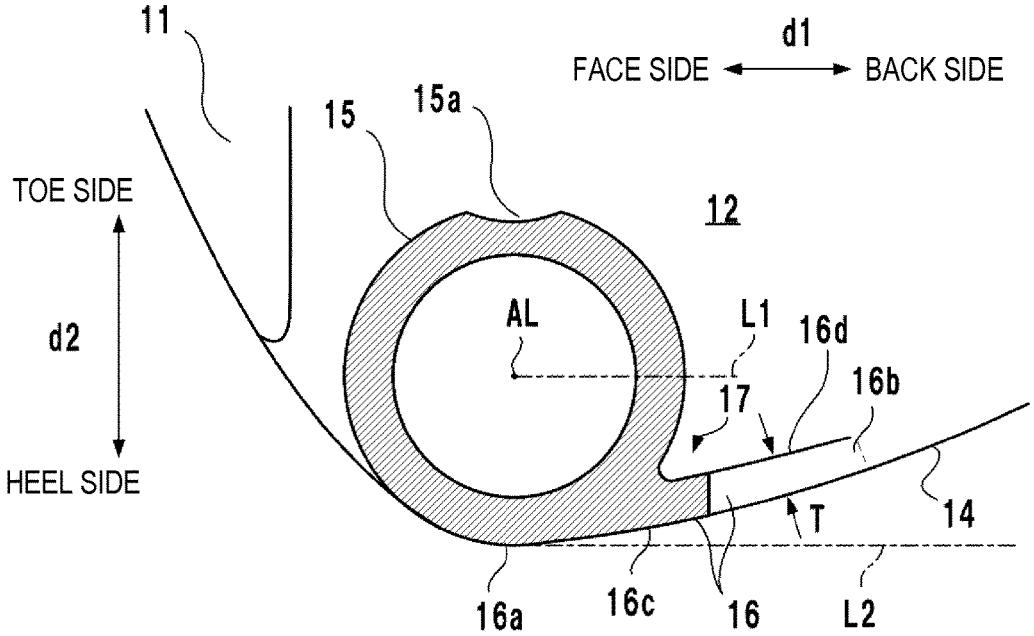
FIG. 3B is a sectional view taken along a line I-I in FIG. 3A.

The hosel portion 15 and the extended portion 16 will be described with reference to FIGS. 3A and 3B in addition to FIGS. 1 and 2. FIG. 3A is a perspective view of the periphery of the hosel portion 15. FIG. 3B is a sectional view taken along a line I-I in FIG. 3A, that is, a sectional view taken along a plane perpendicular to an axis AL of the hosel portion 15.

In this embodiment, the hosel portion 15 has a cylindrical shape. However, the hosel portion 15 may have another tubular shape such as an elliptic cylindrical shape. A concave portion 15*a* is formed in the toe-side outer surface of the hosel portion 15. In this embodiment, the concave portion 15*a* has a circular shape (spherical shape). However, it may have a polygonal shape. When the concave portion 15*a* is provided, the separation position of an airflow at impact can be changed to the back side as compared to a case without the concave portion 15*a*, and the air resistance caused by the presence of the hosel portion 15 can be reduced. The concave portion 15*a* has a depth of, for example, 0.1 mm to 1 mm and a diameter of, for example, 1 mm to 10 mm. The concave portion 15*a* can be provided, in the outer surface of the hosel portion 15, at a position within the hosel diameter in the face-back direction with respect to the toe-side end where the airflow readily separates as the center. The toe-side end position is preferable, as in this embodiment. In this embodiment, only one concave portion 15*a* is provided. However, a plurality of concave portions may be provided. When providing a plurality of concave portions, the plurality of concave portions can be provided in a direction parallel to the axial direction of the hosel portion 15, in the face-back direction, or in both directions.

The extended portion 16 extends from the hosel portion 15 to the back side in the face-back direction. In this embodiment, the extended portion 16 is integrated with the hosel portion 15 and the side portion 14. However, the extended portion 16 may be fixed so as to be detachable from the golf club head 10. In this case, the extended portion 16 may be interchangeable to allow the user to select the extended portion 16 according to his/her taste from a plurality of types of extended portions 16 of different specifications.

In this embodiment, the extended portion 16 is a plate-shaped member having a thickness T. The thickness T can be even or uneven as a whole. A structure other than the plate shape may be employed. From the viewpoint of weight reduction, the extended portion 16 is preferably so thin as to stand a wind pressure. For example, the maximum thickness is 0.5 mm to 15 mm, which is preferably equal to or smaller than the radius of the hosel portion 15. The extended portion 16 has a triangular outer shape. However, a circular shape, a polygonal shape, or a shape including an arcuate portion may be employed. However, the structure of the extended portion 16 is not limited to this.

The extended portion 16 includes a distal end portion 16*a* on the side of the face portion 11, and a rear end portion 16*b* on the back side. The distal end portion 16*a* has a height h in a direction parallel to the axial direction of the hosel portion 15. The height h is, for example, 5 mm to 50 mm. The height of the extended portion 16 gradually decreases from the distal end portion 16*a* to the rear end portion 16*b*. In the rear end portion 16*b*, the height from the surface of the side portion 14 is 0. In this embodiment, the bottom portion of the extended portion 16 is connected to the boundary portion between the side portion 14 and the crown portion 12. However, it may be connected to only the side portion 14 or only the crown portion 12. When the extended portion 16 is connected to the side portion 14 or the crown portion 12, the airflow readily smoothly flows from the extended portion 16 to the side portion 14 or the crown portion 12.

If a maximum length L of the extended portion 16 in the face-back direction (the length between the distal end portion 16*a* and the rear end portion 16*b*) falls within the range of, for example, 5 mm to 50 mm, the air resistance can be reduced without unnecessarily making the hosel portion large.

Referring to FIG. 3B, a line L1 is a virtual line that passes through the axis AL of the hosel portion 15 and crosses the toe-heel direction at right angles. When the outer surface of the hosel portion 15 is divided into a heel-side portion and a toe-side portion by the line L1, the distal end portion 16*a* is connected to the heel-side portion but not to the toe-side portion.

Referring to FIG. 3B, a line L2 is a virtual line that passes through the distal end portion 16*a* and crosses the toe-heel direction at right angles. The rear end portion 16*b* is located on the toe side with respect to the distal end portion 16*a*. The extended portion 16 has a curved shape as a whole that points to the toe side on the back side from the side of the distal end portion 16*a* toward the rear end portion 16*b* along the shape of the side portion and slightly projects to the heel side, and can move the airflow along the head and shift the airflow separation position to the back side.

In this embodiment, a heel-side side surface 16*c* of the extended portion 16 is connected continuously to the outer surface of the hosel portion 15 without any step. This can suppress a turbulent airflow as compared to a case with a step. The side surface 16*c* is also connected continuously to the outer surface of the side portion 14 without any step. This can also suppress a turbulent airflow as compared to a case with a step.

Figure 5:
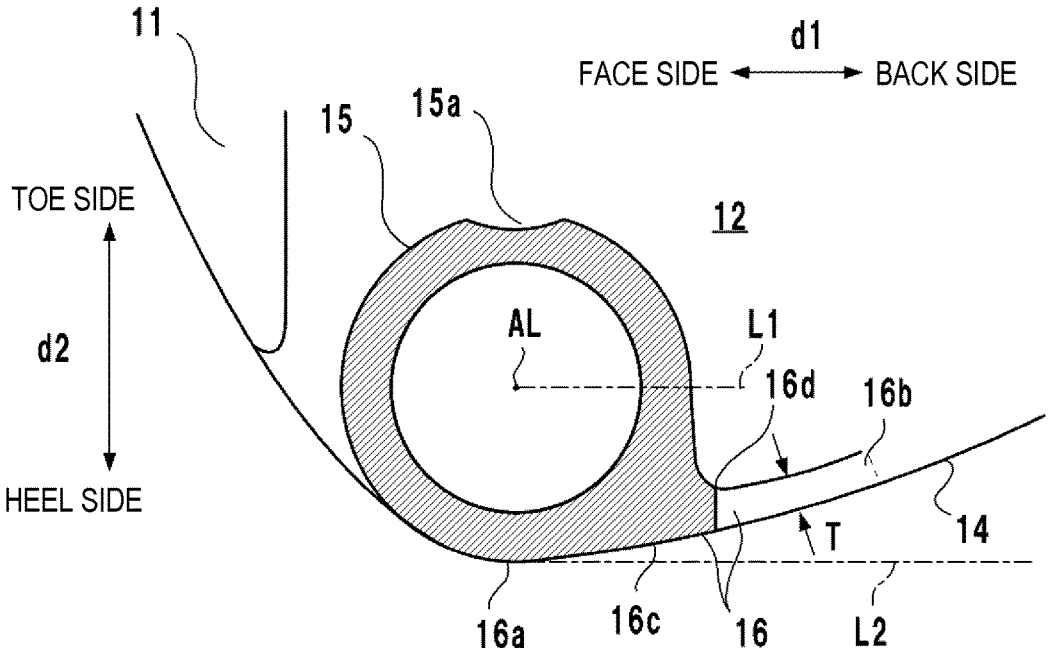
FIG. 5 is a view showing another arrangement example.

In this embodiment, a wedge-shaped space 17 is formed between a toe-side side surface 16*d* of the extended portion 16 and the outer surface of the hosel portion 15. An arrangement that fills the space 17 can also be employed. FIG. 5 shows an example. In the example of FIG. 5, the side surface 16*d* extends from the back end as the starting point out of the outer surface of the hosel portion 15 to the back side while gently curving. The arrangement example of FIG. 3B is advantageous in easily reducing the weight because the space 17 is formed. The arrangement example of FIG. 5 is advantageous in productivity.

Figure 4A:
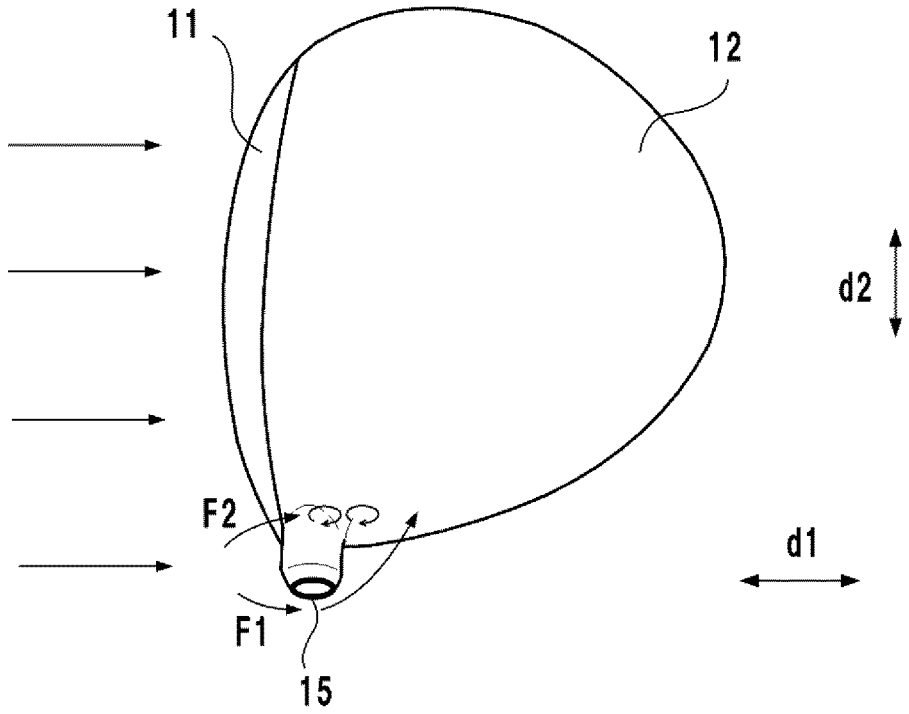
FIGS. 4A and 4B are explanatory views of an air resistance.
Figure 4B:
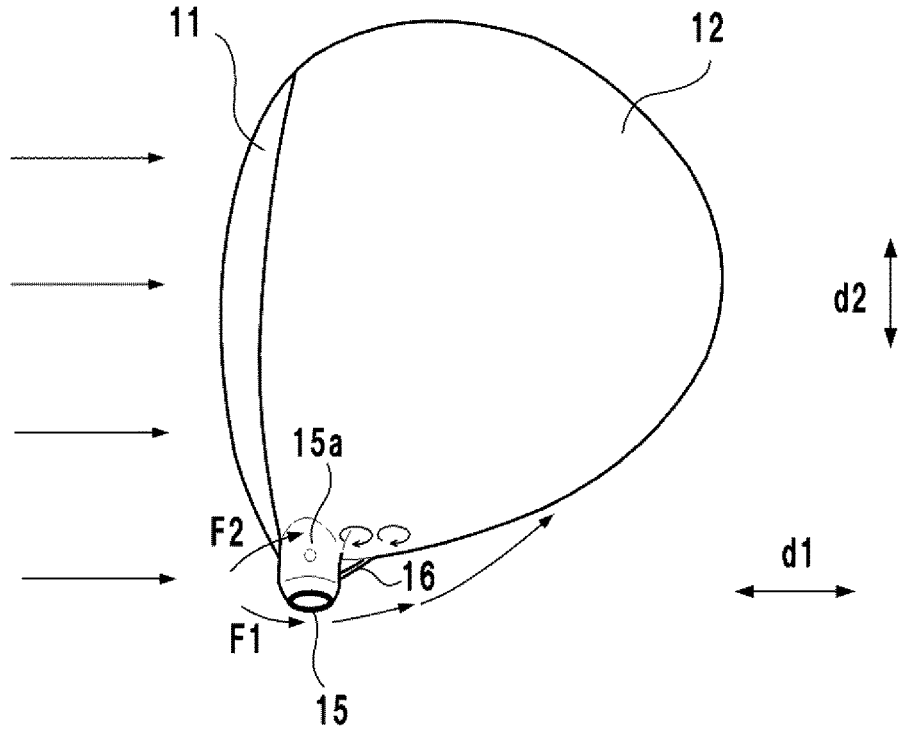

The effect of reducing the air resistance of the hosel portion 15 by the extended portion 16 will be described next with reference to FIGS. 4A and 4B. FIGS. 4A and 4B are views schematically showing an airflow acting on the golf club head 10 immediately before impact. FIG. 4A shows a case where the extended portion 16 is absent as a comparative example. FIG. 4B shows this embodiment.

As shown in FIG. 4A, immediately before impact, the airflow to the golf club head 10 flows in the face-back direction. The airflow around the hosel portion 15 is divided into an airflow F1 flowing on the heel side of the hosel portion 15, and an airflow F2 flowing on the toe side. The airflow F1 passes the hosel portion 15 and, immediately after that, whirls to the toe side and flows onto the crown portion 12. When the airflow F1 flows onto the crown portion 12, the air resistance to the golf club head 10 increases. The airflow F2 early separates from the outer surface of the hosel portion 15, and the air resistance to the golf club head 10 thus increases.

In this embodiment shown in FIG. 4B, the airflow F1 passes the hosel portion 15 and then flows to the back side for a while because of the presence of the extended portion 16. Hence, as compared to the arrangement without the extended portion 16 shown in FIG. 4A, the direction of the airflow flowing onto the crown portion 12 changes, and the airflow separation position on the side portion shifts to the back side. This can reduce the air resistance to the golf club head 10. In addition, since the concave portion 15*a* is provided, the position where the airflow F2 separates from the outer surface of the hosel portion 15 can be changed to the back side. As a result, the air resistance to the golf club head 10 can further be reduced.

As described above, this embodiment is based on an idea that the airflow F1 flowing onto the crown portion 12 while whirling to the toe side largely affects the increase in the air resistance to the golf club head 10. In this embodiment, the extended portion 16 is arranged on the heel side of the hosel portion 15 as a whole so as to actively guide the airflow on the heel side of the hosel portion 15. On the other hand, the extended portion 16 does not actively guide the airflow on the toe side of the hosel portion 15, placing focus on weight reduction. It is therefore possible to suppress an increase in the weight of the golf club head 10 on the heel side caused by the presence of the extended portion 16 while reducing the air resistance of the hosel portion 15.

In addition, the air resistance caused by the airflow on the toe side of the hosel portion 15 can be reduced by the concave portion 15*a* in the outer surface of the hosel portion 15. This also contributes to reduction of the air resistance of the hosel portion 15 without increasing the weight.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-250299, filed Dec. 10, 2014, which is hereby incorporated by reference herein in its entirety.

What is claimed is:

1. A wood type golf club head comprising:

a face portion;

a crown portion;

a sole portion;

a side portion between said crown portion and said sole portion;

a hosel portion in which a shaft is inserted, said hosel portion being provided on a heel side of the golf club head; and an extended portion that extends from said hosel portion to a back side of the golf club head, wherein said extended portion includes a face side end portion on a face portion side and a rear end portion on the back side, out of a heel-side portion and a toe-side portion of said hosel portion, said face side end portion is connected to the heel-side portion, said rear end portion is located on a toe side with respect to said face side end portion said hosel portion has a cylindrical shape and includes a concave portion formed in an outer surface of said hosel portion on the toe side, said side portion includes a heel-side portion to which said extended portion is connected, and said extended portion includes a heel-side side surface that is flush with an outer surface of said hosel portion and an outer surface of said heel-side portion of said side portion.

2. The golf club head according to claim 1, wherein said extended portion has a plate shape.

3. The golf club head according to claim 2, wherein a maximum thickness of said extended portion is not more than a radius of said hosel portion.

4. The golf club head according to claim 2, wherein said extended portion includes a toe-side side surface, and a wedge-shaped space is formed between said toe-side side surface and the outer surface of said hosel portion.

5. The golf club head according to claim 1, wherein said extended portion is connected to said heel-side portion of said side portion at a boundary between said crown portion and said heel-side portion of said side portion.

* * * * *